US011332866B2

(12) United States Patent
Kim et al.

(10) Patent No.: US 11,332,866 B2
(45) Date of Patent: May 17, 2022

(54) LAUNDRY TREATMENT MACHINE

(71) Applicant: LG ELECTRONICS INC., Seoul (KR)

(72) Inventors: Dongcheol Kim, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 97 days.

(21) Appl. No.: 16/683,623

(22) Filed: Nov. 14, 2019

(65) Prior Publication Data

US 2020/0149202 A1 May 14, 2020

(30) Foreign Application Priority Data

Nov. 14, 2018 (KR) ..... 10-2018-0139612

(51) Int. Cl.

| | |
|---|---|
| ***D06F 21/08*** | (2006.01) |
| ***D06F 37/40*** | (2006.01) |
| ***D06F 37/14*** | (2006.01) |
| ***D06F 33/00*** | (2020.01) |
| ***D06F 23/04*** | (2006.01) |
| *D06F 37/24* | (2006.01) |
| *D06F 103/18* | (2020.01) |
| *D06F 105/46* | (2020.01) |

(52) U.S. Cl.

CPC ..... *D06F 21/08* (2013.01); *D06F 23/04* (2013.01); *D06F 33/00* (2013.01); *D06F 37/14* (2013.01); *D06F 37/40* (2013.01); *D06F 37/24* (2013.01); *D06F 2103/18* (2020.02); *D06F 2105/46* (2020.02)

(58) Field of Classification Search

CPC ..... D06F 21/08

See application file for complete search history.

(56) References Cited

U.S. PATENT DOCUMENTS

| | | | |
|---|---|---|---|
| 2004/0040346 A1 | 3/2004 | Hawkins et al. | |
| 2014/0096571 A1* | 4/2014 | Jang | D06F 37/06 68/142 |

FOREIGN PATENT DOCUMENTS

| | | |
|---|---|---|
| CN | 1928198 | 3/2007 |
| CN | 103437127 | 12/2013 |
| CN | 105803725 | 7/2016 |
| KR | 20-0170035 | 3/2000 |

(Continued)

OTHER PUBLICATIONS

International Search Report dated Mar. 18, 2020 issued in Application No. PCT/KR2019/015554.

(Continued)

*Primary Examiner* — Jason Y Ko

(74) *Attorney, Agent, or Firm* — Ked & Associates, LLP

(57) ABSTRACT

A laundry treatment machine may include an outer tub having an opening at a top through which laundry is inserted. The outer tub may contain wash water for washing the laundry. An inner tub may be rotatably provided inside the outer tub. A pulsator may be rotatably provided at a bottom of the inner tub to generate a current or flow of water flowing at a lower part of the inner tub. A water current generating protrusion that protrudes inward from a peripheral surface of the inner tub and extends upward from a bottom end of the inner tub may generate a current or flow of water flowing along an upper part of the inner tub.

18 Claims, 7 Drawing Sheets

(56) References Cited

FOREIGN PATENT DOCUMENTS

| | | |
|---|---|---|
| KR | 10-0271167 | 11/2000 |
| KR | 10-0279592 | 2/2001 |
| KR | 10-2014-0051664 | 5/2014 |

OTHER PUBLICATIONS

Chinese Office Action dated Oct. 11, 2021 issued in Application No. 201911115459.5 (English translation attached).

* cited by examiner

LAUNDRY TREATMENT MACHINE

CROSS-REFERENCE TO RELATED APPLICATION(S)

This application claims priority under 35 U.S.C. § 119 to Korean Application No. 10-2018-0139612 filed on Nov. 14, 2018, whose entire disclosure is hereby incorporated by reference.

FIELD

A laundry treatment machine is disclosed herein.

BACKGROUND

A laundry treatment machine may be an apparatus having wash, rinse, and spin cycles to remove contaminants from clothing, bedding, or other items (hereinafter, referred to as 'laundry') using water, detergent, and mechanical action.

Laundry treatment machines may be implemented as front loading machines or top loading machines. Front loading machines have an entrance hole or opening at a front or side surface, while top loading machines have an entrance hole or opening through a top surface. Laundry may be put into or taken out of the entrance hole.

In a top loading machine, a tub may be filled with water to a certain water level to soak laundry stored in the tub. A pulsator may be placed on the bottom of the tub as the tub spins. The pulsator may generate a current or flow of water mainly at a center of a lower part of wash water stored in the tub, but laundry may be kept at a peripheral surface of upper and lower parts of the tub so as not to be affected by the lower water current or flow, decreasing washing efficiency.

DETAILED DESCRIPTION

Figure 1:
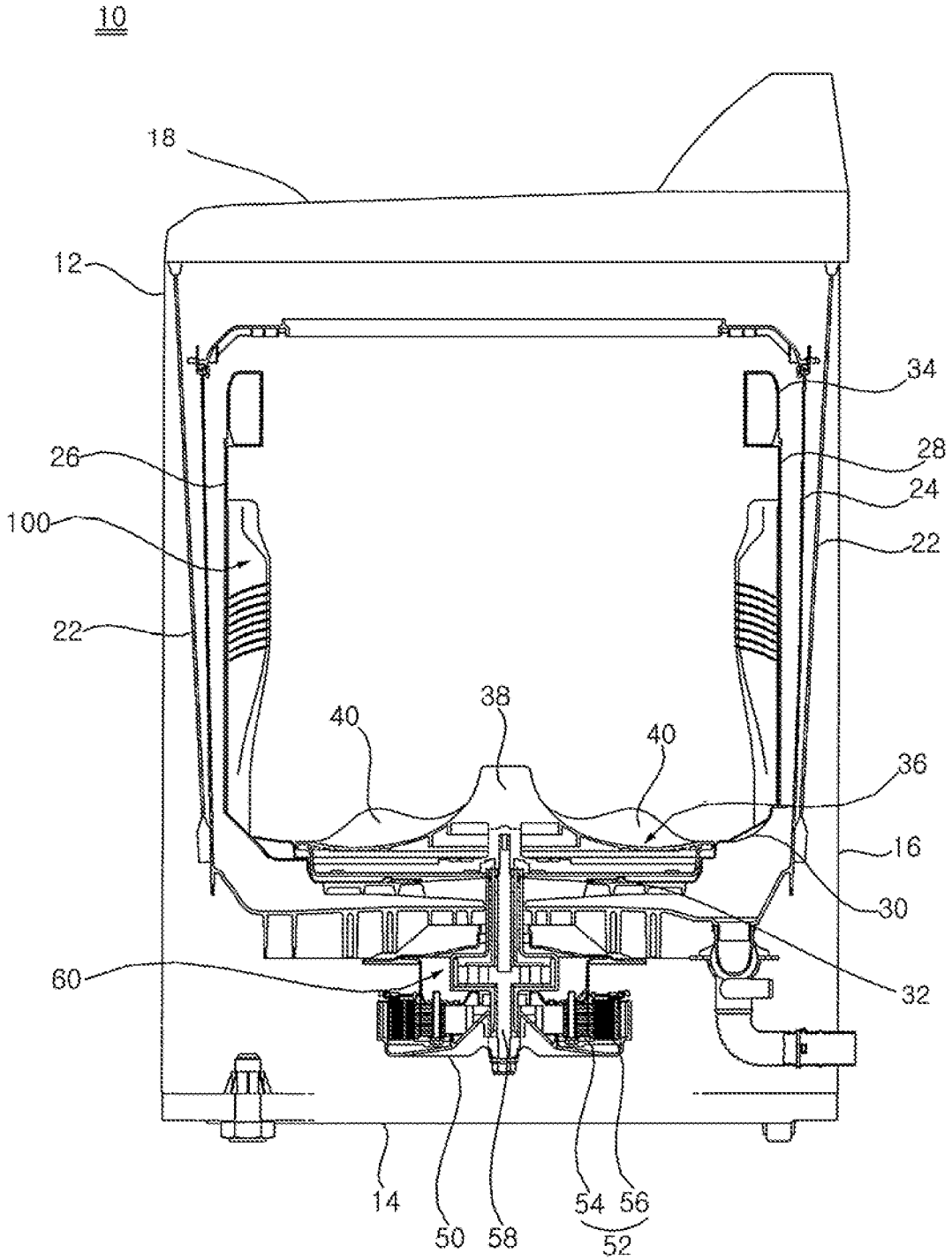
FIG. 1 is a cross-sectional view of an overall configuration of a laundry treatment machine according to an embodiment.

Advantages and features of the present disclosure and methods for achieving them will be made clear from embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the invention to those skilled in the art. The present disclosure is merely defined by the scope of the claims. Like reference numerals refer to like elements throughout the specification. Hereinafter, laundry treatment machines according to exemplary embodiments of the present disclosure will be described with reference to the drawings.

Referring to FIG. 1 an overall configuration of a laundry treatment machine according to an exemplary embodiment will be described. A laundry treatment machine 10 may include a cabinet 12 forming an exterior of the laundry treatment machine 10, an outer tub 24 provided within the cabinet 12 and forming a water-containing space or water storage space, an inner tub 26 rotatably placed inside the outer tub 24 and forming a laundry-containing space or laundry storage space, and a pulsator 36 rotatably provided at a bottom of the inner tub 26 and generating a current or flow of water in wash water supplied at a lower part or first part of the inner tub 26.

The cabinet 12 may have a rectangular or cylindrical shape. The cabinet 12 may include a cabinet base 14 forming a bottom surface of the cabinet 12, a side cabinet or wall 16 forming a peripheral surface of the cabinet 12, and a top cover 18 that forms an entrance hole or opening through which laundry is put into or taken out of the inner tub 26. The top cover 18 may cover a top of the side cabinet 12. A door may be placed on top of the top cover 18 to open and close the entrance hole.

The outer tub 24 may have an open-top cylindrical shape or a cylindrical shell shape. The outer tub 24 may be suspended by a suspension 22 installed in the cabinet 12. The outer tub 24 may store wash water supplied from a water supply assembly. A drain for drawing off water to a water drainage assembly may be provided on an underside of the outer tub 24.

The inner tub 26 may be placed inside the outer tub 24 to be rotatable relative to the outer tub 24. The inner tub 26 may spin, and may be powered by a drive motor 52. The inner tub 26 may include a peripheral surface portion or an inner surface 28 forming a centrifugal peripheral surface of the inner tub 26, a balancer 34 fitted to a top of the peripheral surface portion 28, a base 30 attached to a bottom of the peripheral surface portion 28, and a hub 32 attached to a bottom of the base 30.

Figure 3:
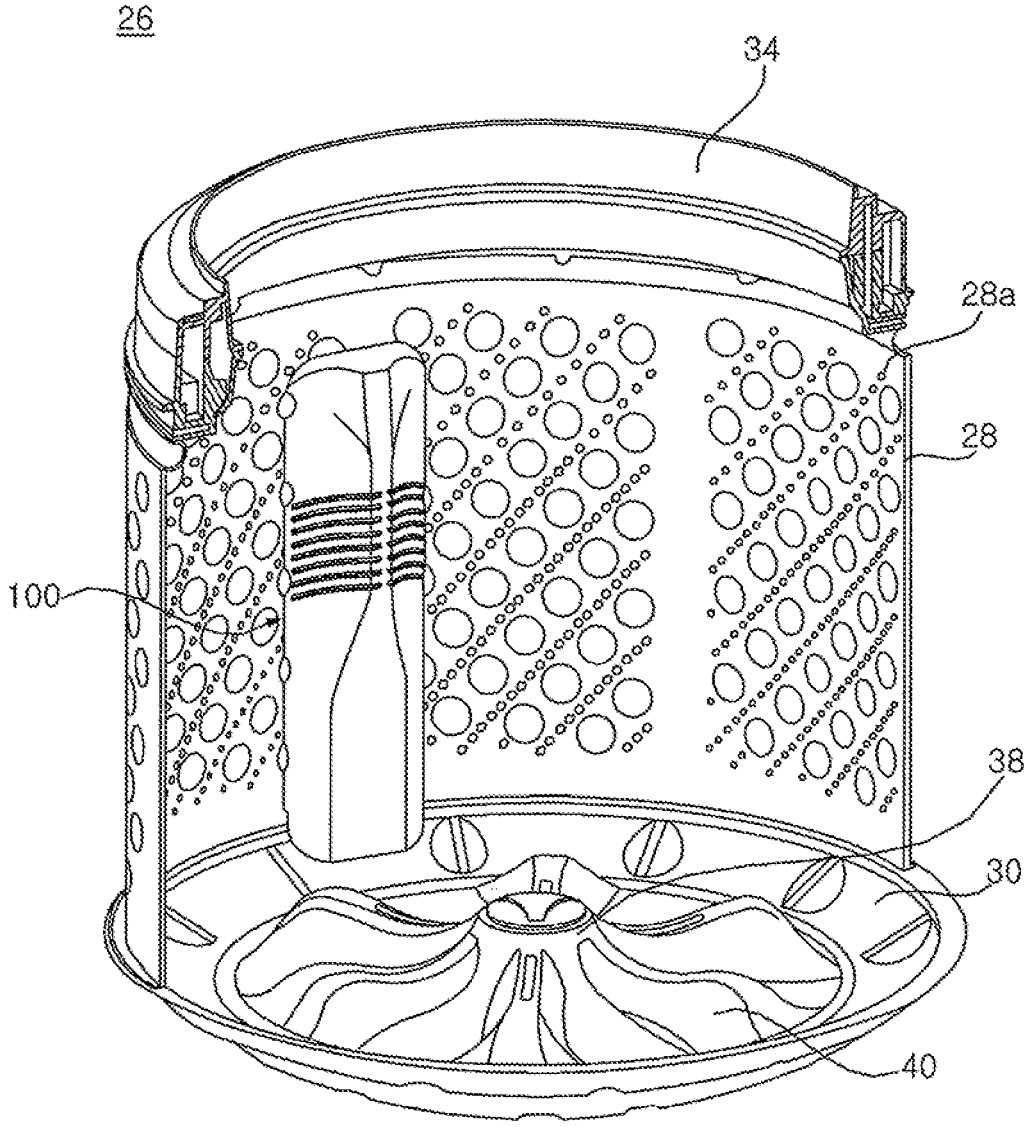
FIG. 3 is a view showing a placement of a water current generating protrusion of a laundry treatment machine according to an embodiment.
Figure 4:
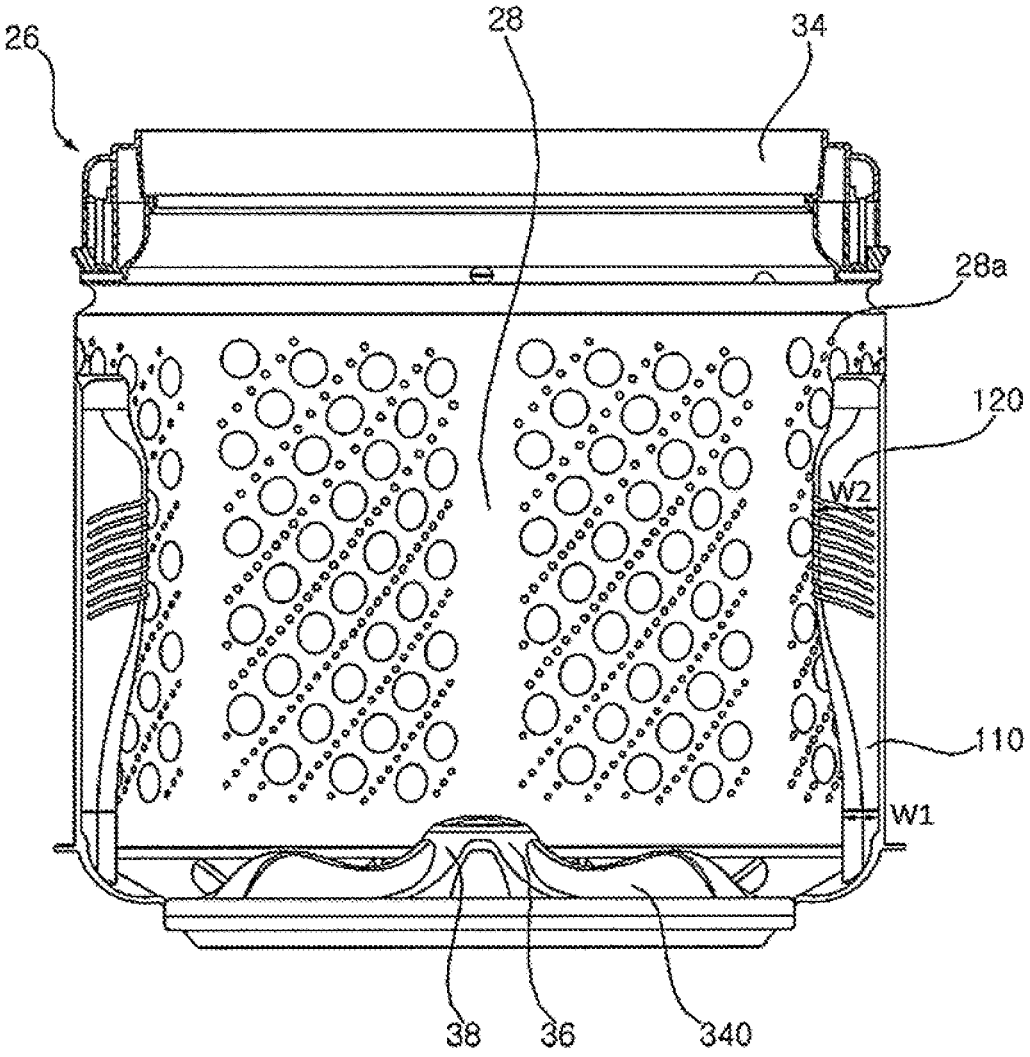
FIG. 4 is a partial cross-sectional view showing the water current generating protrusion placed in an inside of the inner tub according to an embodiment.
Figure 5A:
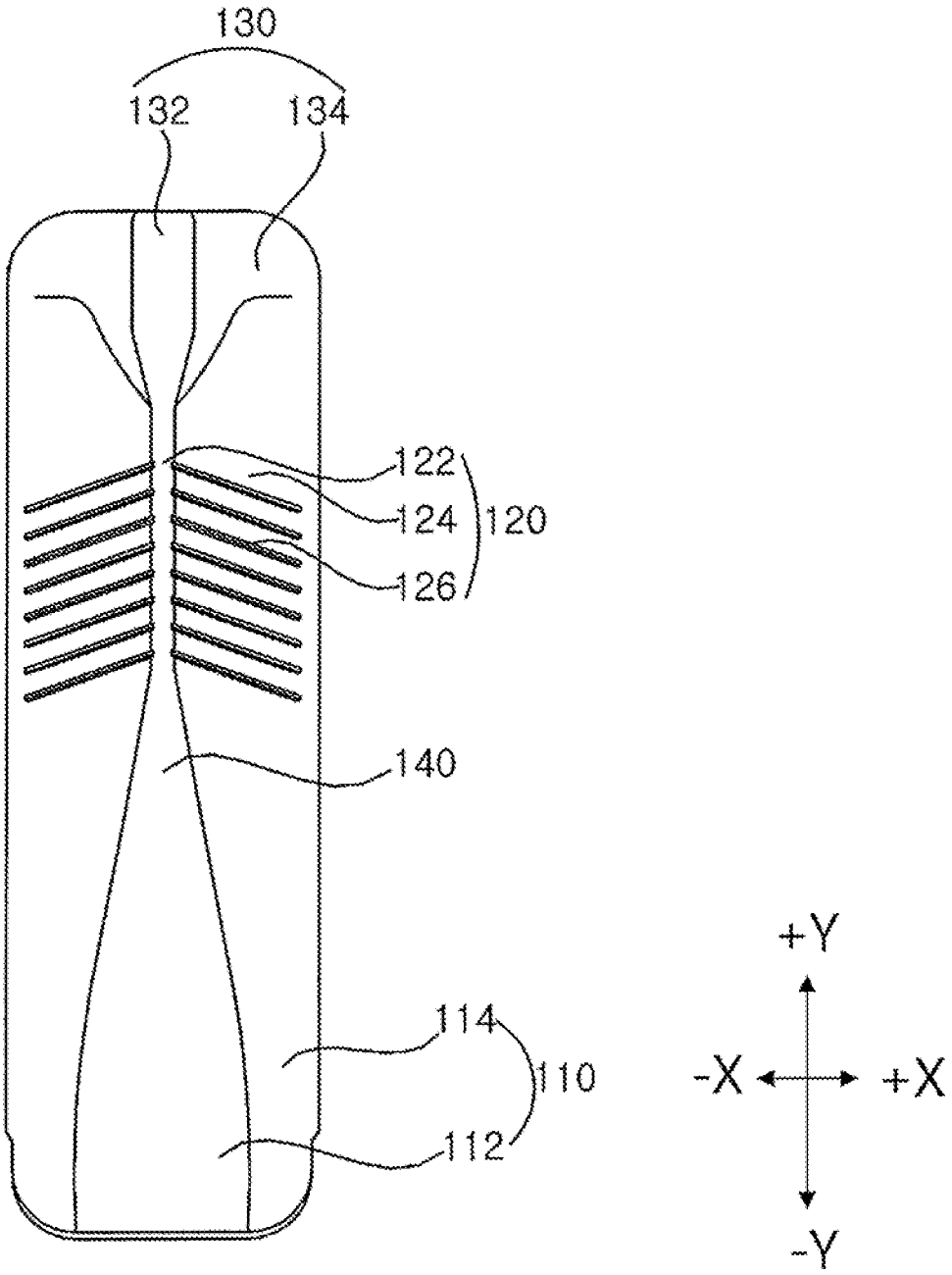
FIG. 5A is a front view of a water current generating protrusion according to an embodiment.
Figure 5B:
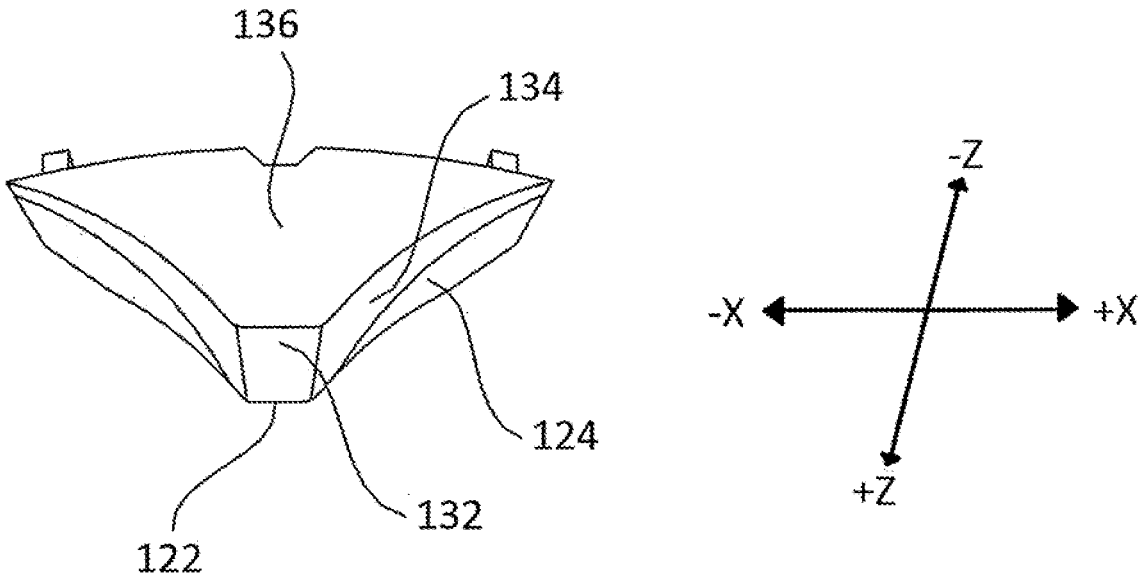
FIG. 5B is a plan view of a water current generating protrusion according to an embodiment.
Figure 5C:
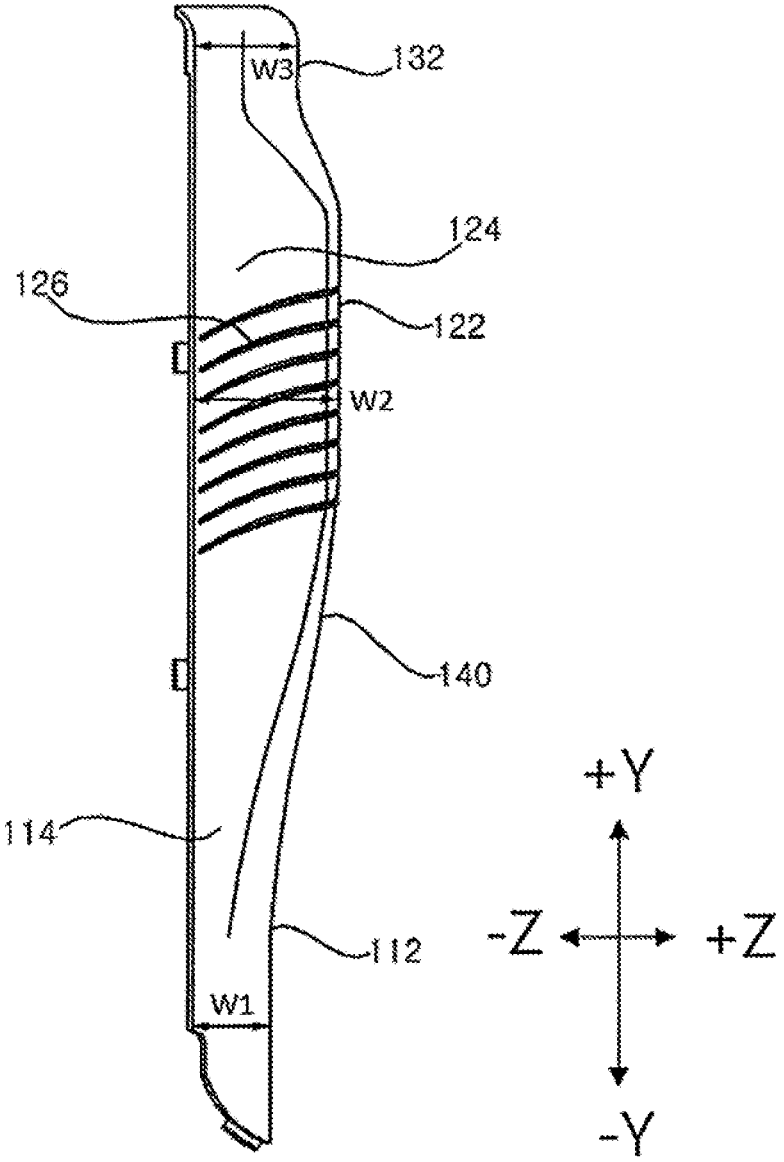
FIG. 5C is a side view of a water current generating protrusion according to an embodiment.

The peripheral surface portion 28 may have a plurality of dewatering holes 28*a* (FIG. 3). Wash water in the outer tub 24 may flow into the inner tub 26 through the dewatering holes 28*a* of the peripheral surface portion 28. The balancer 34 may extend upward from a top of the peripheral surface portion 28 and may have a ring shape. A liquid balancer or ball balancer may be contained within the balancer 34 and prevent a concentration of or an unbalanced load when the inner tub 26 spins.

The peripheral surface portion 28 may also include a water current generating protrusion or a side protrusion 100. The water current generating protrusion 100 may generate or control a current or flow of water at the outer top of the inner tub 26. The water current generating protrusion 100 may also be referred to as a side wall or section, or as a peripheral protrusion, wall, or section.

The base 30 may form an underside of the inner tub 26. An outer portion of the base 30 may have a concave curvature, and a top or outer end of the base 30 may be attached to a bottom end of the peripheral surface portion 28. The base 30 may be recessed downward at a center or inner portion. The pulsator 36 may be placed in a downward-recessed space of the base 30.

The hub 32 may be placed on the bottom of the inner tub 26. The hub 32 may form at least part of a bottom surface of the inner tub 26. The hub 32 may receive torque from the drive motor 52 and transfer the torque to the base 30 and the peripheral surface portion 28. The hub 32 may have a plurality of wash water inlet holes. The wash water inlet holes may be spaced at intervals around a circumference, and the wash water stored in the outer tub 24 may flow into the inner tub 26 through the wash water inlet holes of the hub 32. The hub 32 may be fixed to a bottom side of the base 30 and placed at a center of the base 30.

The laundry treatment machine includes the pulsator 36 provided on the bottom of the inner tub 26 or at a surface of the inner tub 26 opposite the opening through which laundry is inserted. The pulsator 36 may be rotatable relative to the inner tub 26, and may receive power from the drive motor 52. The pulsator 36 may rotate forward and backward (i.e., clockwise and counterclockwise). The pulsator 36 may generate or control a spinning current of water in the wash water at a lower part of the inner tub 26. The rotation of the pulsator 36 may have a scrubbing effect of the laundry loaded in the inner tub 26.

The pulsator 36 may have a rough circular plate-like shape with a plurality of protuberances or waves 40 and a central protruding portion or protrusion 38 protruding upward at a center and a plurality of protuberances 40. The plurality of protuberances 40 may be formed on a top surface of the pulsator 36 to protrude or curve upward around the central protruding portion 38.

The plurality of protuberances 40 may extend centrifugally from the central protruding portion 38. One end (i.e., an inner end) of the protuberances 40 may be connected to the central protruding portion 38, and the other end (i.e., an outer end) of the protuberances 40 may extend toward an outer perimeter of the pulsator 36. The protuberances 40 may be spaced at intervals around the circumference. The protuberances 40 may generate a current of water by spinning the wash water flowing to the inside in forward and backward directions of the pulsator 36.

An upper cap may be mounted on the top of the central protruding portion 38. The central protruding portion 38 may protrude upward to have a height greater than the protuberances 40. The pulsator 36 may have a plurality of through holes, and wash water may flow between the outer tub 24 and the inner tub 26 and into the inner tub 26 via the through holes.

A drive motor 52 and a gearbox 60 to spin the inner tub 26 and pulsator 36 according to an exemplary embodiment will be described with reference to FIGS. 1 and 2. The laundry treatment machine 10 may include a drive motor 52 placed at a bottom outside the outer tub 24. The drive motor 52 may include a rotator 54 and a stator 56. A motor casing 50 may be provided which forms an exterior of the drive motor 52. The rotator 54 and stator 56 may be placed in the motor casing 50. The laundry treatment machine 10 may include a drive shaft 58 that is rotated by the drive motor 52 and a gearbox 60 that transfers torque from the drive shaft 58 to the pulsator 36 or the inner tub 26.

The drive shaft 58 may be placed through the hub 32. The drive shaft 58 may be selectively connected to the hub 32 of the inner tub 26. Accordingly, the inner tub 26 may be rotated separately from the pulsator 36 by the drive motor 52. The drive shaft 58 may be selectively connected to the gearbox 60. When the drive shaft 58 and the gearbox 60 are connected, the pulsator 36 and the inner tub 26 may spin together.

The gearbox 60 may be located at the bottom of the inner tub 26. The gearbox 60 may be connected to the pulsator 36 by penetrating the inner tub 26. The gearbox 60 may be connected to the drive motor 52 via the drive shaft 58 to receive a torque. The gearbox 60 may be connected to the inner tub 26 and the pulsator 36. The gearbox 60 may be selectively connected to the drive motor 52. The gearbox 60 may receive torque from the drive motor 52 and transfer the torque to the inner tub 26 and the pulsator 36.

The gearbox 60 may spin the inner tub 26 and the pulsator 36 in opposite directions. The gearbox 60 may spin the inner tub 26 and the pulsator 36 at different speeds, depending on a size of the laundry load, even if the gearbox 60 is moved at a constant speed from the drive motor 52.

The gearbox 60 may include a sun gear 62 that rotates by being connected to the drive shaft 58 of the drive motor 52, a plurality of planetary gears 64*a*, 64*b*, 64*c*, and 64*d* that rotate when engaged with the sun gear 62, a ring gear 72 that rotates when engaged with the planetary gears 64*a*, 64*b*, 64*c*, and 64*d*, a carrier 66 that connects the planetary gears 64*a*, 64*b*, 64*c*, and 64*d*, and a gear housing 74 to which the ring gear 72 is fixed. The sun gear 62, the planetary gears 64*a*, 64*b*, 64*c*, and 64*d*, and the carrier 66 may be placed in the gear housing 74.

The sun gear 62 may be attached to the drive shaft 58. The sun gear 62 may have gear teeth on an inside or inner peripheral surface and an outside or outer peripheral surface. The drive shaft 58 may be inserted into a cavity of the sun gear 62 to engages with the teeth formed on the inside of the sun gear 62.

The planetary gears 64*a*, 64*b*, 64*c*, and 64*d* may be placed around the sun gear 62. The planetary gears 64*a*, 64*b*, 64*c*, and 64*d* may revolve or rotate on their own axes while revolving about the sun gear 62. The planetary gears 64*a*, 64*b*, 64*c*, and 64*d* may revolve along the teeth formed on the outside of the sun gear 62. The planetary gears 64*a*, 64*b*, 64*c*, and 64*d* may be placed horizontally to (i.e., laterally or radially to) the outer circumference of the sun gear 62 to engage with the teeth on the outside of the sun gear 62.

The ring gear 72 may be placed outside the planetary gears 64*a*, 64*b*, 64*c*, and 64*d*. The ring gear 72 may be fixed to an inside of the gear housing 74. When torque is transferred to the ring gear 72, the gear housing 74 may rotate. The gear housing 74 may be connected to the inner tub 26 to spin the inner tub 26. The gear housing 74 may have a housing projection attached to the inner tub 26. The ring gear 72 may have a ring shape and have teeth on an inner circumference that engage with all of the planetary gears 64*a*, 64*b*, 64*c* at the same time.

The carrier 66 may connect the planetary gears 64*a*, 64*b*, 64*c*, and 64*d* together. The planetary gears 64*a*, 64*b*, 64*c*, and 64*d* may rotate at the same speed by the carrier 66. The carrier 66 may include a carrier shaft 68 attached to the pulsator 36. The carrier 66 may be located above the planetary gears 64*a*, 64*b*, 64*c*, and 64*d*. The carrier 66 may have planetary gear axes or shafts 70*a*, 70*b*, 70*c*, and 70*d*, and the planetary gears 64*a*, 64*b*, 64*c*, and 64*d* may revolve or rotate around the planetary gear axes 70*a*, 70*b*, 70*c*, and 70*d*.

When the drive shaft 58 is rotated by the drive motor 52, the carrier 66 and the gear housing 74 rotate. Accordingly, a rotation of the drive motor 52 may allow the pulsator 36, which is connected to the carrier 66, and the inner tub 26, which is connected to the gear housing 74, to spin.

The carrier 66 (and therefore the pulsator 36) and the gear housing 74 (and therefore the inner tub 26) may spin in opposite directions. When the drive shaft 58 rotates, the pulsator 36 and the inner tub 26 may spin according to the following equation:

$$\omega_C = \omega_P = \frac{Z_S\omega_S + Z_R\omega_R}{Z_S + Z_R}$$

wherein $\omega_c$ and $\omega_p$ are the rotations per minute (RPM) of the carrier 66 and pulsator 36, respectively, $\omega_s$ is the RPM of the sun gear 62 and drive shaft 58, $\omega_R$ is the RPM of the ring gear 72 and inner tub 26, $Z_S$ is the number of teeth of the sun gear 62, and $Z_R$ is the number of teeth of the ring gear 72.

When a wash mode or rinse mode is performed to fill the inner tub 26 to a certain water level or predetermined water amount, the inner tub 26 and the pulsator 36 may spin in different directions. A sensor may be provided to sense a water level or water amount in the inner tub 26. As an example, the sensor may be a weight sensor provided at a bottom of the inner tub 26 or between the inner and outer tubs 26 and 24, or the sensor may be a submersible sensor or capacitance sensor provided at a predetermined position in the inner tub 26. As for the spin speed of the inner tub 26 and the spin speed of the pulsator 36, the inner tub 26 and the pulsator 36 may spin according to the above equation depending on the load on the pulsator 36 and the load on the inner tub 26, respectively.

A water current generating protrusion or side protrusion 100 according to an exemplary embodiment will be described with reference to FIGS. 3 to 5C. Regarding these figures, a description will be made with respect to a spatial orthogonal coordinate system where X, Y, and Z axes are orthogonal to each other in order to explain the water current generating protrusion 100. Each axis direction (X-axis direction, Y-axis direction, and Z-axis direction) refers to two directions in which each axis runs. Each axis direction with a '+' sign in front of it (+X-axis direction, +Y-axis direction, and +Z-axis direction) refers to a positive direction which is one of the two directions in which each axis runs. Each axis direction with a '−' sign in front of it (−X-axis direction, −Y-axis direction, and −Z-axis direction) refers to a negative direction which is the other of the two directions in which each axis runs.

The laundry treatment machine 10 according to this exemplary embodiment may include a water current generating protrusion 100 that protrudes inward from the peripheral surface portion 28 of the inner tub 26. The water current generating protrusion 100 may generate a current of water in an upper art of wash water adjacent to the a top of the peripheral surface portion 28 of the inner tub 26.

Figure 2:
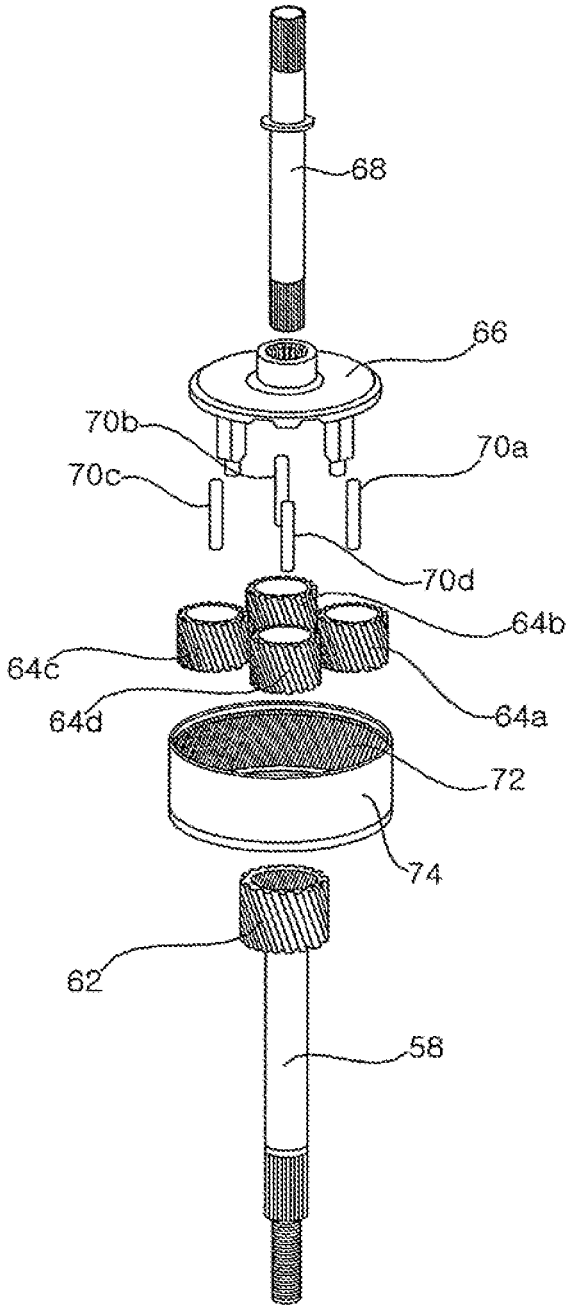
FIG. 2 is an exploded view of a gearbox for spinning an inner tub and a pulsator according to an embodiment.

When washing is performed using the laundry treatment machine 10, which uses the gearbox 60 shown in FIGS. 1 and 2, the pulsator 36 may generate a current of water at a lower center of the inner tub 26 while the water current generating protrusion 100 may generate a current of water at the outer top of the inner tub 26.

The water current generating protrusion 100 may extend upward and outward from a bottom end of the peripheral surface portion 28 of the inner tub 26. A width or thickness of the water current generating protrusion 100 may increase from a bottom to a top. That is, the thickness of the water current generating protrusion 100 in the −Z to +Z direction may get larger from the −Y to +Y direction. The width in the −Z to +Z direction may also be referred to as a depth.

A plurality of water current generating protrusions 100 may be formed on the peripheral surface portion 28 of the inner tub 26. The water current generating protrusions 100 may be placed at intervals along the circumference of the peripheral surface portion 28. As an example, two or three water current generating protrusions 100 may be placed on the peripheral surface of the inner tub 26 at equal intervals (i.e., at 180° or 120°, respectively), but embodiments disclosed herein are not limited to two or three water current generating protrusions 100.

The water current generating protrusion 100 may include a lower protrusion or section 110 and an upper protrusion or section 120. The lower protrusion 110 and the upper protrusion 120 may also be referred to as first and second protrusions or sections, respectively. The lower protrusion or section 110 may be placed at a lower part of the inner tub 26 and may protrude by a first protruding width W1 or less to generate a spinning current of water in the wash water at the lower part of the inner tub 26. The upper protrusion 120 may be placed above the lower protrusion 110 and may protrude by a second protruding width W2, which may be greater than the first protruding width W1 to generate a spinning current of water in the wash water at an upper part or second part of the inner tub 26.

The width of the lower protrusion 110 may be smaller than the first protruding width W1. The first protruding width W1 may be set or predetermined by taking into account the height of the plurality of protuberances 40 of the pulsator 36. The first protruding width W1 to which the lower protrusion 110 protrudes may be set within a range to reduce a probability of laundry getting stuck between the lower protrusion 110 and the protuberances 40 of the pulsator 36.

The lower protrusion 110 may have a width equal to or greater than a set or predetermined height of the protuberances 40. The height of the protuberances 40 may run in a lengthwise or height direction (−Y and +Y). A height or position of the upper protrusion 120 with respect to the lower protrusion 110, in addition to the width W2 of the upper protrusion 120, may be set or predetermined by taking the heights of the protuberances 40 of the pulsator 36 into consideration.

The width of the lower protrusion 110 from the peripheral surface portion 28 may increase toward a center of the lower protrusion 110 (i.e., in the −X and +X direction). The lower protrusion 110 may have a width equal to the first protruding width W1 at a central part. However, the central part at which the lower protrusion 110 has the first protruding width W1 may be wider or longer in the −X to X direction at a bottom section, and narrower or shorter at a top section.

The lower protrusion 110 may include a lower periphery or side portion 114 formed at sides and a lower center portion 112 formed at the central part. The side portion 114 may have a first side portion at a first side of the lower center portion 112 and a second side portion at a second side of the lower center portion 112. The lower center portion 112 may have a width equal to the first protruding width W1. The lower center portion 112 may have a length in the −X to X direction that decreases in an upward direction (i.e., in the −Y to Y direction). A length of the lower center portion 112 along the Y direction may be less than the first protruding width W1 along the Z direction, but embodiments disclosed herein are not limited hereto. The lower periphery portion 114 may have a width that increases from either end toward the lower center portion 112 to approach the first protruding width W1. The lower periphery portion 114 may occupy less area than the lower center portion 112. The lower periphery portion 114 may bulge toward the center of the inner tub 26 and/or have a convex curvature from the lower center portion 112.

The width at which the upper protrusion 120 protrudes from the peripheral surface portion 28 may increase toward a center of the upper protrusion 120 (i.e., in the −X and +X direction). The width of the upper protrusion 120 may be equal to the second protruding width W2 at a central part. The central part at which the upper protrusion 120 has the second protruding width W2 may be narrower or shorter in the −X and +X than the central part at which the lower protrusion 110 has the first protruding width W1.

The upper protrusion 120 may include an upper periphery or side portion 124 formed at sides and an upper center portion 122 formed at the central part. The side portion 124 may include a first side portion at a first side of the upper center portion 122 and a second side portion at a second side of the upper center portion 122. The upper center portion 122 may have a width equal to the second protruding width W1. The upper center portion 122 may have a length in the −X to X direction that increases in an upward direction (i.e., in the −Y to Y direction). A length of the upper center portion 122 along the Y direction may be less than the second protruding width W1 along the Z direction, but embodiments disclosed herein are not limited hereto. The upper periphery portion 124 may have a width that increases from either end toward the upper center portion 122 to approach the second protruding width W2. The upper periphery portion 124 may occupy more area than the upper center portion 122. The upper periphery portion 124 may be concave inward from the upper center portion 122 toward the inner tub 26. Therefore, a spinning current of water may be generated in the wash water filling the top of the inner tub 26.

The water current generating protrusion 100 may further include a connecting portion 140 that connects the lower protrusion 110 and the upper protrusion 120. The connecting portion 140 may extend seamlessly from the width at which the lower protrusion 110 protrudes to the width at which the upper protrusion 120 protrudes.

The upper protrusion 120 may include a guide rib 126 that protrudes in the direction of rotation of the water current generating protrusion 100 from a surface where the upper protrusion 120 faces the center of the inner tub 26. The guide rib 126 may have an increasing width −X and +X toward the center. The guide ribs 126 may be provided on the upper periphery portion 124, and have an increasing width as the guide ribs 126 approach the upper center portion 124. A plurality of guide ribs 126 may be placed along and spaced apart in the −Y to Y direction of the upper protrusion 120. The guide ribs 126 may be placed at intervals in the −Y to Y direction. A plurality of guide ribs 126 may be vertically formed in the up-down direction and also placed at intervals around a circumference of the peripheral surface portion 28.

The water current generating protrusion 100 may further include an upper end protrusion or section 130 on an upper side of the upper protrusion 120. The upper end protrusion may protrude at a third protruding width W3 that is less than the second protruding width W2. A height of the upper end protrusion 130 in the −Y to Y direction may be less than the second protruding width W2 in the −Z to Z direction, but embodiments disclosed herein are not limited thereto. The upper end protrusion 130 may apply a spinning force to a current of water rising around the peripheral surface of the inner tub 26 by the torque generated from the inside of the inner tub 26 by the spinning of the pulsator 36 or inner tub 26.

The upper end protrusion 130 may include an upper end periphery portion 134 and an upper end center portion 132. The upper end center portion 132 may have a width equal to the third protruding width W3. A length of the center portion 132 in the −X to X direction may be thicker or longer than the length of the upper center portion 122 in the −X to X direction and narrower or shorter than the length of the lower center portion 112 in the −X to X direction. The upper end periphery portion 134 may have a protruding width W which increases from either end toward the upper end center portion 132 to approach the third protruding width W3. The third protruding width W3 of the upper end center portion 132 may be smaller than the second protruding width W2 of the upper center portion 122 and larger than the first protruding width W1 of the lower center portion 112. The upper periphery portion 124 may be concave inward from a bottom of the upper end periphery portion 134 downward. A top surface 136 of the upper end portion 130 may define a top of the water generating current portion 100. The top surface 136 may face a bottom of the balancer 34.

Although the exemplary embodiments of the present disclosure have been illustrated and described above, the present disclosure is not limited to the aforementioned specific embodiments, various modifications may be made by a person with ordinary skill in the technical field to which the present disclosure pertains without departing from the subject matters of the present disclosure that are claimed in the claims, and these modifications should not be appreciated individually from the technical spirit or prospect of the present disclosure.

Although a top-loading laundry machine is described, embodiments disclosed herein may be implemented as a front loading machine having a projection or protrusion extending forward from a back wall, and side wall protrusions extending from sides of the inner tub. Embodiments disclosed herein may be implemented as a laundry treatment machine to offer one or more of the following advantages.

Embodiments disclosed herein may provide a water current generating protrusion or a side wall or protrusion which may generate or control a current or flow of water at an upper part of the inner tub where it is not easy to generate a current of water by spinning a pulsator. Thus, a current of water can be generated throughout the wash water present in the inner tub, whereby washing can be performed effectively.

Embodiments disclosed herein may provide a pulsator and an inner tub. The pulsator and an inner tub spin at a constant rate in opposite directions by means of a gearbox. This may allow the wash water in the inner tub to circulate evenly and make washing faster.

The effects of the present disclosure are not limited to the aforementioned effects, and other effects, which are not mentioned above, will be clearly understood by those skilled in the art from the claims. The problems solved by the present disclosure are not limited to the above-mentioned problems, and other problems not mentioned can be clearly understood by those skilled in the art from the following description.

Embodiments disclosed herein may be implemented as a laundry treatment machine that generates a current or flow of water throughout upper and lower parts of the wash water stored in a tub. The laundry treatment machine may reduce overall washing time by making faster a circulation of wash water present in a tub.

Embodiments disclosed herein may be implemented as a laundry treatment machine including an outer tub that has an opening at the top through which laundry is put into or taken out of the machine and contains wash water for washing the laundry, an inner tub rotatably placed inside the outer tub, a pulsator or a protrusion rotatably provided on the bottom of the inner tub and generating a current of water in the wash water at a lower part of the inner tub, and a water current generating protrusion or a side protrusion that protrudes inward from a peripheral surface portion of the inner tub and extends upward from the bottom end of the inner tub.

A height or width at which the water current generating protrusion may protrude from the peripheral surface portion of the inner tub may become larger from the bottom to the top. The water current generating protrusion may include a lower protrusion that is placed at a lower part of the inner tub and protrudes at a first protruding height or width or below toward a center axis of the inner tub from the peripheral surface portion of the inner tub so as to generate a spinning current of water in the wash water at the lower part of the inner tub. The water current generating protrusion may include an upper protrusion that is placed above the lower protrusion and protrudes at a second protruding height or width which is greater than the first protruding height to generate a spinning current of water in the wash water at an upper part of the inner tub.

The lower protrusion may protrude in a plate-like shape inward from the inner tub. The height at which the upper protrusion protrudes inward from the inner tub may get larger from both ends of the width to the center.

The upper protrusion may include an upper periphery portion which increases in height or width from both ends of the width to the center and an upper center portion which has the second protruding height or width at a central part. The upper periphery portion may form a curved surface that is concave inward from the upper protrusion.

The upper protrusion may include a guide rib that extends and protrudes from both ends of the width to the center. A plurality of guide ribs may be placed at intervals in an up-down direction of the upper protrusion.

When a wash mode or rinse mode is performed to fill the inner tub to a certain water level, the inner tub and the pulsator may spin in different directions so that the pulsator and the water current generating protrusion generate a current of water within the inner tub.

The laundry treatment machine may further include a drive motor that generates torque on the pulsator and the inner tub, a drive shaft that is connected to the drive motor and rotates together with the drive motor, a sun gear that rotates together with the drive shaft, a plurality of planetary gears that rotate in engagement with the outer circumference of the sun gear, a carrier formed by planetary gear axes that are connected together and penetrate the centers of the planetary gears, respectively, a ring gear that engages with the planetary gears while in internal contact with the same, and a gear housing in which the ring gear is fixed to an inner surface. The pulsator may spin by receiving torque from the carrier, and the inner tub may spin by receiving torque from the gear housing.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment machine, comprising:

an outer tub having an opening through which laundry is inserted, the outer tub being configured to store wash water for washing the laundry;

an inner tub rotatably provided inside the outer tub;

a pulsator rotatably provided at a side of the inner tub opposite to the opening, the pulsator being configured to generate a flow of water in the wash water at a first part of the inner tub that is closer to the side than the opening; and a peripheral protrusion that protrudes inward from a peripheral surface of the inner tub and extends lengthwise along a lengthwise direction of the inner tub, wherein the pulsator is provided at a bottom of the inner tub, the opening is provided at a top of the outer tub, and the lengthwise direction of the inner tub is a vertical direction.

2. The laundry treatment machine of claim 1, wherein a width at which the peripheral protrusion protrudes from the peripheral surface of the inner tub increases in the lengthwise direction.

3. The laundry treatment machine of claim 1, wherein the peripheral protrusion comprises:

a first section provided in the first part of the inner tub, the first section protruding by a first protruding width or less toward a center axis of the inner tub so as to generate a spinning flow of water in the first part of the inner tub; and a second section provided in a second part of the tub that is closer to the opening than the side, the second section protruding by a second protruding width which is greater than the first protruding width to generate a spinning flow of water in the second part of the inner tub.

4. The laundry treatment machine of claim 3, wherein the first section of the peripheral protrusion includes a side portion and a center portion, the center portion having a width equal to the first protruding width and the side portion having a width that increases from the peripheral surface of the inner tub toward the center portion.

5. The laundry treatment machine of claim 3, wherein the second section of the peripheral protrusion includes a side portion and a center portion, the center portion having a width equal to the second protruding width and the side portion having a width that increases from the peripheral surface of the inner tub toward the center portion.

6. The laundry treatment machine of claim 5, wherein the side portion includes a first side portion at a first side of the center portion and a second side portion at a second side of the center portion, and each of the first and second side portions have a concave curvature.

7. The laundry treatment machine of claim 5, wherein the second section includes a guide rib extending between side ends of the side portion toward the center portion.

8. The laundry treatment machine of claim 7, wherein a plurality of guide ribs are placed at intervals along the lengthwise direction on the second section.

9. The laundry treatment machine of claim 1, wherein, when water provided in the inner tub reaches at least one of a predetermined water level or a predetermined water amount, the inner tub and the pulsator spin in different directions.

10. The laundry treatment machine of claim 1, further comprising:

a drive motor that generates torque on the pulsator and the inner tub;

a drive shaft coupled to the drive motor to rotate via the drive motor;

a sun gear coupled to the drive shaft to rotate together with the drive shaft;

a plurality of planetary gears that engage with an outer circumference of the sun gear to rotate;

a carrier having a plurality of planetary gear axes inserted through and coupled to centers of the plurality of planetary gears, respectively;

a ring gear that engages with outer surfaces of the planetary gears; and a gear housing having an inner surface to which the ring gear is fixed, wherein the pulsator spins by receiving torque from the carrier, and the inner tub spins by receiving torque from the gear housing.

11. The laundry treatment machine of claim 1, wherein the pulsator includes a protrusion protruding toward the opening and a plurality of protuberances to surround the pulsator.

12. The laundry treatment machine of claim 11, wherein the protrusion protrudes toward the opening by a first predetermined length and the protuberances protrude toward the opening by a second predetermined length less than or equal to the first predetermined length.

13. The laundry treatment machine of claim 12, wherein the peripheral protrusion includes a first section that protrudes toward a center of the inner tub by a predetermined width that is set based on the second predetermined length of the protuberances.

14. A laundry treatment machine, comprising:

an outer tub having an opening through which laundry is inserted;

an inner tub provided inside the outer tub;

a pulsator provided at a side of the inner tub opposite to the opening, the pulsator having a protrusion extending toward the opening; and a drive motor provided at the side of the inner tub, the drive motor configured to rotate at least one of the inner tub or the pulsator, wherein, when a water level in the inner tub reaches a predetermined water level, the pulsator and the inner tub rotate in opposite directions, and wherein a gearbox is coupled to the pulsator, the drive motor is configured to be coupled to and decoupled from the gearbox, and the gearbox includes:

a sun gear coupled to a top of a drive shaft of the drive motor, the sun gear rotating with the drive shaft;

a plurality of planetary gears that engage with an outer circumference of the sun gear to rotate;

a ring gear having an inner surface that engages with outer surfaces of the planetary gears;

a gear housing having an inner surface to which the ring gear is fixed, the gear housing being coupled to the inner tub;

a carrier having a plurality of planetary gear axes inserted through and coupled to centers of the plurality of planetary gears, respectively; and a carrier shaft coupled to the carrier and the pulsator.

15. The laundry treatment machine of claim 14, wherein, when the drive shaft rotates, the pulsator and the inner tub spin according to the following equation:

$$\omega_C = \omega_P = \frac{Z_S\omega_S + Z_R\omega_R}{Z_S + Z_R}$$

where $\omega_c$ and $\omega_p$ are the rotations per minute (RPM) of the carrier and pulsator, respectively, $\omega_s$ is the RPM of the sun gear and drive shaft, $\Omega_R$ is the RPM of the ring gear and inner tub, $Z_S$ is the number of teeth formed on the outer circumference of the sun gear, and $Z_R$ is the number of teeth formed on the inner surface of the ring gear.

16. The laundry treatment machine of claim 14, wherein the protrusion protrudes from a center of the side of the inner tub, and a plurality of concave and convex curves are formed in an outer portion of the pulsator to surround the protrusion.

17. The laundry treatment machine of claim 14, further comprising at least one protrusion formed on an inner surface of the inner tub and protruding toward a center of the inner tub.

18. A laundry treatment machine, comprising:

an outer tub having an opening through which laundry is inserted, the outer tub being configured to store wash water for washing the laundry;

an inner tub rotatably provided inside the outer tub;

a pulsator rotatably provided at a side of the inner tub opposite to the opening, the pulsator being configured to generate a flow of water in the wash water at a first part of the inner tub that is closer to the side than the opening; and a peripheral protrusion that protrudes inward from a peripheral surface of the inner tub and extends lengthwise along a lengthwise direction of the inner tub;

a drive motor that generates torque on the pulsator and the inner tub;

a drive shaft coupled to the drive motor to rotate via the drive motor;

a sun gear coupled to the drive shaft to rotate together with the drive shaft;

a plurality of planetary gears that engage with an outer circumference of the sun gear to rotate;

a carrier having a plurality of planetary gear axes inserted through and coupled to centers of the plurality of planetary gears, respectively;

a ring gear that engages with outer surfaces of the planetary gears; and a gear housing having an inner surface to which the ring gear is fixed, wherein the pulsator spins by receiving torque from the carrier, and the inner tub spins by receiving torque from the gear housing.

* * * * *